US005205008A

United States Patent [19]

Kohnen et al.

[11] Patent Number: 5,205,008

[45] Date of Patent: Apr. 27, 1993

[54] METHOD FOR PRETREATING CONTINUOUS TEXTILE MATERIAL HAVING AT LEAST ONE TUFTED SIDE, PARTICULARLY CARPET GOODS, BEFORE A DYEING PROCESS

[75] Inventors: Julius Kohnen; Johannes Kutz, both of Toisvorst, Fed. Rep. of Germany

[73] Assignee: Eduard Küsters Maschinenfabrik GmbH & Co. KG, Krefeld, Fed. Rep. of Germany

[21] Appl. No.: 948,620

[22] Filed: Sep. 23, 1992

Related U.S. Application Data

[60] Continuation of Ser. No. 827,304, Jan. 29, 1992, abandoned, which is a division of Ser. No. 552,700, Jul. 16, 1990, abandoned.

[51] Int. Cl.[5] ..... D06B 3/18; D06B 15/00; D06B 21/00

[52] U.S. Cl. ..... 8/149.1; 8/151; 68/5 D; 68/9; 68/19.1; 68/20; 118/68; 427/381

[58] Field of Search ..... 8/149.1, 151; 68/5 D, 68/5 E, 9, 19.1, 20, 22 B; 118/68, 424; 427/359, 365, 381, 434.4; 28/179, 183

[56] References Cited

U.S. PATENT DOCUMENTS

| | | | |
|---|---|---|---|
| 3,382,086 | 5/1968 | Singleton | 427/381 X |
| 3,800,565 | 4/1974 | Worth et al. | 68/5 D |
| 3,844,813 | 10/1974 | Leonard et al. | 427/365 X |
| 4,010,709 | 3/1977 | Sayman et al. | 68/5 D X |
| 4,495,783 | 1/1985 | Sando et al. | 68/5 D |
| 4,862,713 | 9/1989 | Kutz et al. | 68/22 B X |

FOREIGN PATENT DOCUMENTS

| | | | |
|---|---|---|---|
| 3536912 | 4/1987 | Fed. Rep. of Germany | 68/20 |

*Primary Examiner*—Philip R. Coe
*Attorney, Agent, or Firm*—Kenyon & Kenyon

[57] ABSTRACT

An undyed carpet web is pretreated by applying a liquid preparatory agent in a gap of an applicator. Subsequent to the application of the preparatory agent, the carpet web is detained in a dwell apparatus. The web is then suctioned off in a hydroextraction device and steamed in a steaming machine before the dyeing operation begins.

5 Claims, 1 Drawing Sheet

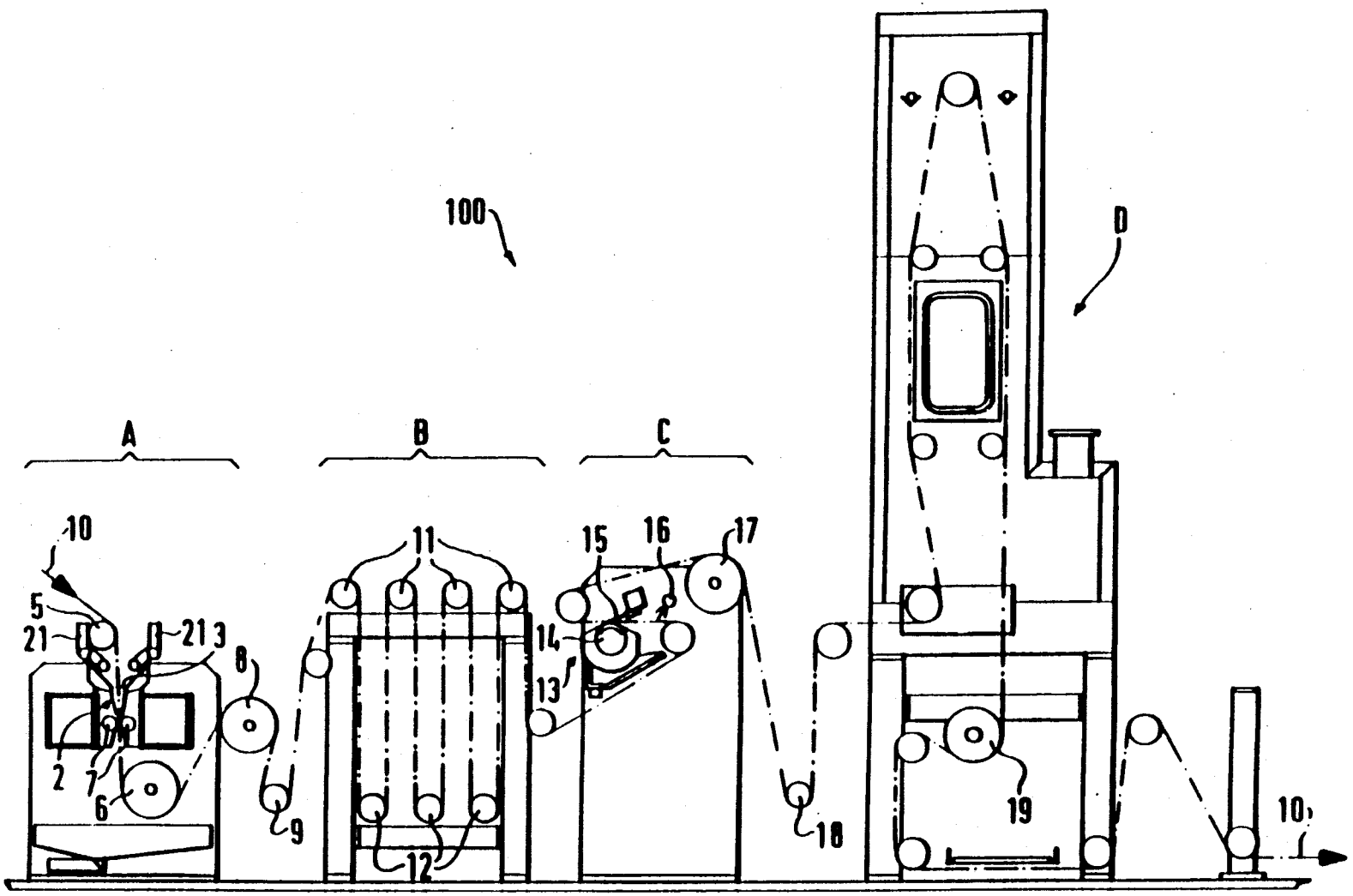
100
A
B
C
D
10
5
21
2
7
6
8
3
9
11
12
13
14
15
16
17
18
19
10'

METHOD FOR PRETREATING CONTINUOUS TEXTILE MATERIAL HAVING AT LEAST ONE TUFTED SIDE, PARTICULARLY CARPET GOODS, BEFORE A DYEING PROCESS

This application is a continuation of application Ser. No. 07/827,304, filed Jan. 29, 1992, now abandoned, which is a division of application Ser. No. 07,552,700 filed Jul. 16, 1990, now abandoned.

BACKGROUND OF THE INVENTION

The invention relates generally to a method for pretreating continuous textile material having a tufted carpet web and, more particularly, to an improved method for pretreating carpet goods before a dyeing process.

A method and apparatus for pretreating a continuous textile web is disclosed in DE-AS 16 35 004. This document describes guiding a carpet web through a basin of a padding machine or foulard filled with a wetting agent. The wetting agent is squeezed out in a specified manner, and then a dyeing liquid is immediately applied to the web.

Various problems have occurred when tufted carpet webs are pretreated, and subsequently dyed according to the above-described prior art. To lengthen the useful lifetime of the tufting needles used in the ever faster-running tufting machines, larger and larger quantities of finishes or spinning oils must be applied to the fibers. Among their other uses, these finishes and spinning oils are used as lubricants in the carpet tufting process. The finishes and spinning oils remain on the carpet goods and, in conventional dyeing processes, very often result in an uneven fixation of the dye, thus producing cloudy patches and a sandwich effect on the dyed carpet goods. The sandwich effect occurs when the fiber tips are dyed to a lesser degree than the remaining material. The foam used to dye the carpet goods dyes the fiber tips particularly well, and thus, the sandwich effect and the cloudy patches are avoided. However, the finishes and the spinning oils on the carpet web destroy the dyeing foam in the steaming machine and thus the result is a cloudy coloration on the carpet goods.

Problems are caused not only by the quantity of finishes or spinning oils used, but also by the type of finishes or spinning oils that are used. Of course, the price per kilogram of these processing aids is very important. Therefore, inexpensive finishes are often applied to the fibers. Although these inexpensive finishes are effective during the tufting operation, they cause considerable problems during the subsequent dyeing process.

Further problems can occur during the storage of the tufted, untreated carpet material (rolls having a width of 4 to 5 m, for example) over a long period of time. Amongst other things, the carpet edges become damp and then dry out again, which causes the finishes and spinning oils present at the edges to become altered in comparison to the finishes and spinning oils at the middle of the carpet. This nonuniformity may vary the color of the carpet material and result in uneven carpet dyeing over the width of the carpet surface.

When a pretreatment process is carried out in the padding machine, such as disclosed in DE-AS 16 35 004, the finishes and the spinning oils accumulate in the trough of the padding machine and are then subsequently picked up again by the carpet web in a nonuniform manner, thereby interfering with the coloration. When the known technique is used, obstinate coating agents, such as the above-mentioned finishes and spinning oils, cannot be effectively removed.

SUMMARY OF THE INVENTION

The invention is directed to providing a method for pretreating continuous textile material before a dyeing process occurs that avoids the above-mentioned problems and disadvantages of the prior art.

The invention solves these problems and avoids these disadvantages by providing a method for pretreating a continuous textile web having at least one tufted side that includes the following steps. The web to be pretreated is guided essentially vertically through a wedge-shaped gap filled with a preparatory agent from the top of the gap to the bottom. The preparatory agent is applied to the textile web as the web passes through the gap. The preparatory agent is wiped off the web at a lower end of the gap. The web is conducted through air for a predetermined dwell time before the web is hydro-extracted to a predetermined moisture content.

Due to the special type of application of the preparatory agent of the invention, in which the web is guided through a vertical gap, only a comparatively small quantity of the preparatory agent comes into contact with the web. The preparatory agent is constantly being resupplied. If the preparatory agent were not continuously resupplied to the gap, as in the present invention, the amount of the agent available in the gap would be used up in a few seconds. Harmful quantities of chemicals, such as finishes and spinning oils derived from preceding treatment steps, cannot collect in such a small quantity of liquid, which is resupplied again and again over such a short time period. This is unlike the situation that occurs in larger baths, such as found in the trough of a padding machine, or even in a roller vat.

Since the chemicals, particularly the finishes and spinning oils, are generally not easily removed, the preparatory agent should be given a period of time to become effective. If the preparatory agent is a rinsing agent, it can partially dissolve the chemicals found on the web during the dwell time it remains on the web and, moreover, can penetrate efficiently between the fibers. The result is a textile material that is thoroughly prepared for the subsequent application of the liquid dye.

The present invention is not directed merely to the idea of pretreating or prewashing a carpet web, but rather concerns a particular type of preparatory agent application in which the web comes into contact with only a small amount of the preparatory agent and then is subjected to a dwell time to increase the effectiveness of the preparatory agent. The preparatory agent can be a rinsing agent to remove the chemicals, for example the above-mentioned finishes and spinning oils, present on the web from preceding manufacturing steps. However, it is also possible to apply other types of preparatory agents.

It has been shown that dwell times of approximately 30 to 90 seconds are expedient to partially dissolve and then thoroughly remove the chemicals present on the web, such as finishes and spinning oils.

The first machine found in man continuous-dyeing installations is a preliminary steamer. In this machine, the textile material is prepared for the dyeing operation, and any creases or markings resulting from storage are removed. However, it is not possible to very successfully remove such markings when dry material is steamed. If, however, the web is steamed, in accordance with a technique of the invention, after the water is extracted and before the dyeing process, then the material conducted to the steaming machine arrives with a controlled moisture content. This process results in much improved crease removal and, additionally, the material acquires a particularly advantageous bulk.

According to another aspect of the invention, an apparatus is provided for pretreating a continuous textile web having at least one tufted side that includes an applicator for applying a preparatory agent to the web. The applicator includes means for defining a gap to be filled up to a predetermined filling level with a preparatory agent. The gap is arranged to extend across the width of a web to be treated in the applicator and has a top end inwardly tapering toward its bottom end. At least one member seals the bottom end of the gap such that the member may exert pressure on at least one side of a web conducted through the gap. At least one counter-member extends across the width of the web conducted through the gap. The counter-member faces the sealing member such that the sealing member elastically presses against the web and the counter-member as the web is guided through the bottom end of the gap. The pretreatment apparatus also includes a hydroextraction device disposed downstream from the applicator in the direction of travel of a web conducted through the applicator and a dwell apparatus arranged between the applicator and the hydroextraction device. The dwell apparatus conducts the web as it emerges from the applicator through the surrounding air before it is fed to the hydroextraction device.

Use of an applicator that constitutes the first component of the installation and has a vertical gap sealed at the bottom through which a web is guided from the top of the gap to the bottom is disclosed in French Patent 1 381 081.

The dwell apparatus in which the dwell time is developed may include a first row of deflecting rolls and a second row of deflecting rolls disposed above the first row in a vertical direction. The deflecting rolls of the first row may be horizontally offset from the rolls of the second row, whereby a web conducted over the first and second rows of deflecting rolls is guided in vertically extending loops.

The hydroextraction device may be formed by a suction gap because use of a suction gap exerts a minimum of stresses on the fibrous structure of the tuft.

As already mentioned, the steaming machine is arranged downstream from the hydroextraction device and improves the quality of the material and prepares it for the subsequent dyeing operation.

A though the invention is not limited to a method in which the pretreatment and dyeing installation is operated in a continuous mode and the web is immediately subject to the dyeing operation before it leaves the steaming machine, such a method is preferred.

Further features, advantages, and embodiments of the invention are apparent from consideration of the following detailed description, drawings and appended claims.

BRIEF DESCRIPTION OF THE DRAWING

The sole drawing FIGURE illustrates a side view of an apparatus for pretreating carpets constructed according to the principles of the present invention.

DETAILED DESCRIPTION

The apparatus 100 is used to pretreat, before dyeing, a web 10 that consists of a carpet material having a tufted side. The web 10 is conducted in the direction indicated by the arrows through the apparatus 100. The web 10 sequentially passes through the following devices: an applicator A containing the preparatory agent; a detainment station in the form of a dwell apparatus B; a hydroextraction device in the form of a suction device C; and a steaming machine D.

The applicator A comprises a vertical gap 2 that extends over the width of the web 10. This gap 2 is filled up to a filling level 3 with a liquid preparatory agent that is continuously supplied from supply conduits 21. The quantity of liquid contained in the gap 2 is small; if the working width of the gap is 4 m, the quantity of liquid is about 25 liters. The web 10 is guided vertically over guide rolls 5 and 6 from the top to the bottom and through the gap 2. The web absorbs the preparatory agent in the gap 2, which is subsequently wiped off from both sides of the web 2 by two inflatable tubes 7 disposed below the gap 2. The inflatable tubes 7 extend across the width of the web 10. These tubes 7 define and seal the bottom end of gap 2 so that no significant quantities of the preparatory agent can run downward and out of the gap 2.

The web 10 is next led over the driven deflecting roll 8, which provides the necessary amount of tension to guide the web 10 through the gap 2, as well as over a compensator 9, before feeding the web 10 into the dwell apparatus B. In the embodiment shown in the FIGURE, the dwell apparatus B includes a series of four upper deflecting rolls 11, which are all arranged at the same height and parallel to one another. The dwell apparatus B also includes a series of three deflecting rolls 12 spaced vertically below and horizontally offset from the deflecting rolls 11. The web is guided over the deflecting rolls 12 in vertically extending loops in the manner illustrated in the FIGURE.

The fabric web 10 then arrives in the hydroextraction device C, which includes a suction device 13. The suction device 13 comprises a suction tube 14 disposed below a horizontal section of the web 10 and a pressure element 15 disposed above the suction device. A spray device 16 can also be arranged at a point beyond the suction device 13. The hydroextraction device C can also comprise several suction devices 13 which are connected together in series with spray devices 16. The suctioning of the web 10 in the suction device 13 produces a residual moisture content of 30% to 70%. The tension required to bring the web 10 between the suction tube 14 and the pressure device 15 is produced by a driven roll 17 located beyond the suction tube 14.

The web 10 then runs over a compensator 18 and into the steaming machine D. In the embodiment shown in the FIGURE, the web 10 only forms an upright loop in the steaming machine D. After leaving the steaming machine, the web 10 passes a driving roll which conducts the web through the end of the pretreatment apparatus 100 to begin the dyeing operation.

The following example describes the use of the pretreatment apparatus 100. First, assume a carpet material having a tufted pile of 6.6 nylon and an adhesive-bonded (nonwoven) backing with a fabric weight of 700 $g/m^2$ is to be treated in the apparatus 100. An aqueous preparatory agent having a chemical concentration of 0.5 g/l of washing and wetting agents is applied in the applicator A in a quantity of approximately 400% of the dry material. The web is then detained in the dwell apparatus B for about one minute. After passing through the suction device, the web has a residual moisture content of approximately 50%. With this residual moisture, the web enters the steamer D, where it is also detained for about one minute. After the subsequent dyeing and fixation procedure, a carpet web results that has no cloudy patches and does not exhibit a sandwich effect.

What is claimed is:

1. A method of pretreating a continuous textile web having at least on tufted side before the web is dyed, said method comprising the steps of:

a. guiding the undyed web in an essentially vertical manner through a wedge-shaped gap filled with a preparatory agent;

b. applying the preparatory agent to the undyed web by conducting the web into the gap;

c. wiping off the preparatory agent from the undyed web at a lower end of the gap;

d. conducting the undyed web through surrounding air for a predetermined dwell time; and e. hydroextracting the undyed web to a predetermined moisture content after the predetermined dwell time has passed.

2. The method of claim 1 wherein said predetermined dwell time is approximately 30 to 90 seconds.

3. The method of claim 2 further comprising the step of steaming the web after hydroextraction and before a dyeing operation.

4. The method of claim 1 further comprising the step of steaming the web after hydroextraction and before a dyeing operation.

5. The method of claim 1 wherein the continuous textile web comprises an undyed carpet material.

* * * * *